US009788656B2

(12) United States Patent
Sanza Pilas

(10) Patent No.: US 9,788,656 B2
(45) Date of Patent: Oct. 17, 2017

(54) TRANSPORTABLE FOLDER-CHAIR

(71) Applicant: EQUX ESTUDIO DE DISENO, S.L., Saragossa (ES)

(72) Inventor: Miguel Sanza Pilas, Saragossa (ES)

(73) Assignee: EQUX ESTUDIO DE DISENO, S.L., Saragossa (ES)

( * ) Notice: Subject to any disclaimer, the term of this patent is extended or adjusted under 35 U.S.C. 154(b) by 42 days.

(21) Appl. No.: 14/771,381

(22) PCT Filed: Feb. 11, 2014

(86) PCT No.: PCT/ES2014/070095

§ 371 (c)(1),
(2) Date: Aug. 28, 2015

(87) PCT Pub. No.: WO2014/135723

PCT Pub. Date: Sep. 12, 2014

(65) Prior Publication Data

US 2016/0000226 A1 Jan. 7, 2016

(30) Foreign Application Priority Data

Mar. 6, 2013 (ES) ..... 201330275

(51) Int. Cl.
*A47C 4/52* (2006.01)
*A47C 9/10* (2006.01)
*A47C 4/28* (2006.01)

(52) U.S. Cl.
CPC ..... *A47C 4/52* (2013.01); *A47C 4/283* (2013.01); *A47C 9/10* (2013.01)

(58) Field of Classification Search
CPC .. A47C 4/52; A47C 4/283; A47C 9/10; A47C 5/005; A47C 1/146; A47D 1/02
USPC ..... 297/4, 17, 180.01, 180.02, 344.12, 297/440.12; 248/174
See application file for complete search history.

(56) References Cited

U.S. PATENT DOCUMENTS 2,047,035 A * 7/1936 Rosenberg ..... A45C 9/00 190/1
3,126,140 A * 3/1964 Lizan ..... A47C 5/005 108/115

(Continued)

FOREIGN PATENT DOCUMENTS

ES 1068528 U 11/2008
ES 1074232 U 4/2011

(Continued)

OTHER PUBLICATIONS

International Search Report dated Feb. 28, 2014 for Application No. PCT/ES2013/070844 and English translation.

*Primary Examiner* — Brian Glessner
*Assistant Examiner* — Adam Barlow
(74) *Attorney, Agent, or Firm* — Lucas & Mercanti, LLP

(57) ABSTRACT

Transportable folder-chair formed by two foldable/unfoldable parts, one of which is rectangular prismatic with two flat faces and two faces in the form of bellows, with extensions for forming the seat surface in an unfolded position, or position of use of the chair, which continue in flaps with two cutouts, and a set of flaps and fold lines, from which a folder is formed in the fold thereof. The transportable folder-chair also has a strap fixed by two ends for transporting the unit in the folded position thereof.

6 Claims, 4 Drawing Sheets

(56) References Cited

U.S. PATENT DOCUMENTS 3,331,634 A * 7/1967 Harrison, Jr. ..... A47C 4/03 297/440.12
3,606,459 A * 9/1971 Krone ..... A47C 5/005 297/440.12
4,273,221 A * 6/1981 Poag ..... A45C 9/00 190/1
4,775,188 A * 10/1988 Fuchs ..... A47C 1/146 297/129
4,889,383 A * 12/1989 Jones ..... A47C 4/02 297/16.1
4,955,665 A * 9/1990 Richer ..... A47C 4/52 160/84.04
5,499,860 A * 3/1996 Smith ..... A47D 1/103 297/183.5
5,573,288 A * 11/1996 Raffensperger ..... A47C 1/16 297/188.1
5,785,427 A * 7/1998 Godshaw ..... A45F 4/02 190/8
5,819,999 A * 10/1998 Tennant ..... A45F 4/02 224/153
6,048,032 A * 4/2000 Stewart ..... A47C 5/005 248/174
2004/0251717 A1* 12/2004 Tamura ..... A45C 15/00 297/17
2008/0157582 A1* 7/2008 Bertele ..... A47B 43/02 297/440.12
2009/0159385 A1* 6/2009 Poissant ..... A47C 13/00 190/8
2013/0069400 A1* 3/2013 Nikolic ..... A47C 4/286 297/184.15
2013/0099540 A1* 4/2013 Lucas ..... A47C 3/20 297/340
2016/0000226 A1* 1/2016 Sanza Pilas ..... A47C 4/52 297/4

FOREIGN PATENT DOCUMENTS

FR 2440709 A2 6/1980
FR 2505636 A3 11/1982
JP S53129510 U 10/1978
WO 2011140880 A1 11/2011

* cited by examiner

TRANSPORTABLE FOLDER-CHAIR

CROSS REFERENCE TO RELATED APPLICATION

This Application is a 371 of PCT/ES2014/070095 filed on Feb. 11, 2014 which, in turn, claimed the priority of Spanish Patent Application No. 201330275 filed on Mar. 6, 2013, both applications are incorporated herein by reference.

OBJECT OF THE INVENTION

The present invention relates to a transportable folder-chair, forming a single unit in which two parts with different uses are established with a foldable nature, one as a chair in the corresponding folding and assembly of the general structure and another as a folder which allows documents to be carried and which can be folded and unfolded with respect to the part which forms the seat.

The object of the invention is to provide a support for transporting and storing documents, using for this a folder as part of the object of the invention as well as forming a resting element or chair usable at any time.

The folder-chair is preferably made of cardboard or polypropylene and in any case is complemented by a belt for the transport thereof.

BACKGROUND OF THE INVENTION

In the Spanish utility module with publication number ES 1074232 U, a cardboard stool is described which is formed by a rectangular prismatic body, with two flat faces and the other two forming bellows, with the object of allowing the folding of the body such that the support is carried out by way of one of the bases which form the body referred to and which is open while the seat surface per se is formed by two extensions derived from the lateral planes corresponding to the upper opposing edge, extensions which have a central cutout and a transversal fold line for linking such extensions, following the folding of the sections which are determined by way of the fold line in the vertices or dihedrals which are determined at the top of the faces in the form of bellows of the body, thus forming a chair or stool which allows the use thereof at any time and which logically, when it is not used, completely folds forming a practically flat body.

This stool has no other function than that of a seat, also having the drawback that the stability of the same leaves much to be desired since the link between the cutouts of the extensions forming the seat surface and the upper dihedrals or vertices of the faces in the form of bellows can be separated in the face of movements which produce a deformation and definitively instability with respect to the prismatic body which forms the seat per se.

In the Spanish utility model with publication number ES 1068528 U, another fast-erecting stool is described, which provides an upper surface based on various sections and has an independent element which is couplable in this upper part, providing a high resistance or rigidity to unit of the stool and therefore greater stability during the use thereof.

However, the stool corresponding to this utility model which has just been mentioned, is complex both in the manufacture thereof and the erecting or assembly thereof.

In these models, as in others which it is not appropriate to assess, the stool has no other function than that of a seat at a determined time and with one or another form, does not offer other benefits.

DESCRIPTION OF THE INVENTION

The folder-chair which is envisaged has the particularity that in one single unit or completely foldable body, there are established, on the one hand, a folder for documents and on the other hand a seat structure.

More specifically, the folder-chair of the invention has a prismatic body with two flat faces and two in the form of bellows, as is common, however, with the special particularity that the extensions which must form the upper seat surface have a transversal fold line and at the free edge thereof two cutouts which correspond to others provided for such purpose in the upper part of the edge or vertex which determine the lateral faces in the form of bellows, such that both upper extensions are perfectly connected to the laterals in the form of bellows, preventing these from folding or unfolding and preventing an undesired dismantling of the structure of the chair or seat being carried out.

On one of the lateral faces in the form of bellows, the fixing of the ends of a belt for transport is envisaged while an extension corresponding to a folder is derived from the opposing face and corresponding to the corresponding edge following a double fold line, an extension which has the same size as one of the flat lateral faces of the prismatic body of the chair or seat and furthermore, has two wings corresponding to two of the opposing edges thereof, and a wing corresponding to the edge opposed to that of the fold line which connects this extension of the folder to the prismatic body, defining in the folding of this extension, the folder per se, which can be opened by way of the fin derived in opposition to the double fold line with which it is joined to the structure of the seat, both the fin and the corresponding face of the body of the seat having fastening or fixing means for maintaining the folder in a closed position since this is determined by the flaps or extensions previously mentioned, the closing flap and of course the face which forms one of the laterals, precisely that from which the folder is derived, of the prismatic body of the seat.

The fixing of the folder to the chair, in the folded position, can be implemented in various ways, for example, by means of complementary (17) tabs and cutouts and provided in one or another part; by means of adhesive Velcro® portions, by means of fastening elements such as clasps, hooks, etc.

Consequently, by means of one single body and from the development of a sheet of cardboard or polypropylene, the double element can be obtained which corresponds to a chair and to a folder in a folded position of the latter and in an unfolded position of the chair or seat, it being completely foldable so as to occupy a minimum volume and being transportable by means of the transport belt in the form of a shoulder strap, by hand as well as if it is a carrying case or briefcase.

DESCRIPTION OF THE DRAWINGS

In order to complement the description below and with the aim of aiding a better understanding of the characteristics of the invention, in accordance with a practical preferred exemplary embodiment, a set of drawings are attached as an integral part of said description, in which the following is represented in an illustrative and non-limiting manner.

PREFERRED EMBODIMENT OF THE INVENTION

Figure 1:
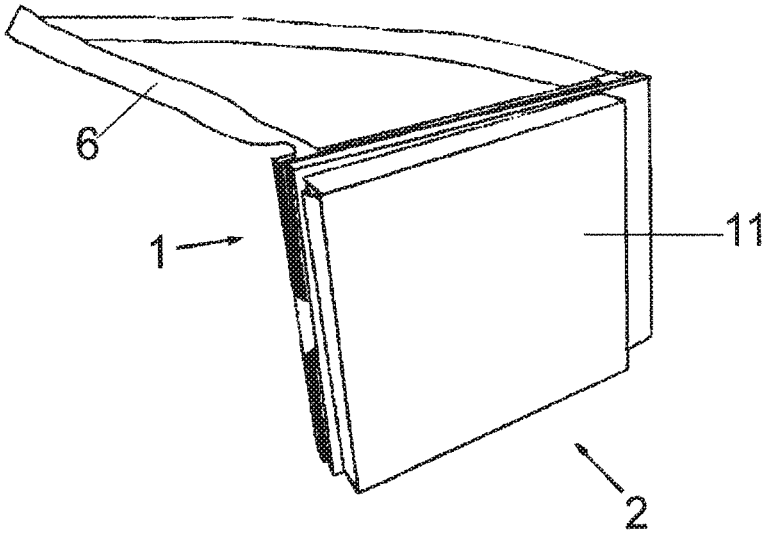
FIG. 1 shows a perspective view of the folder-chair object of the invention in a completely folded position.
Figure 2:
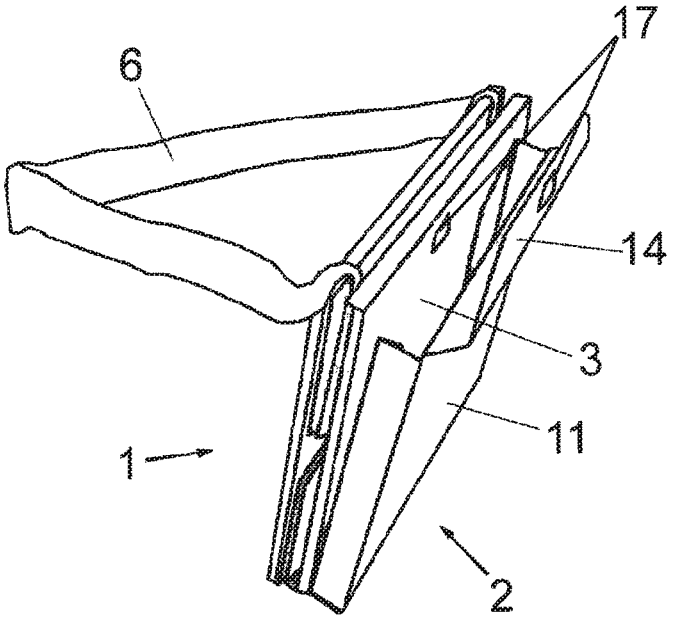
FIG. 2 shows a perspective view in a folded position, but starting from the opening of the folder by way of the closing flap of the same.
Figure 3:
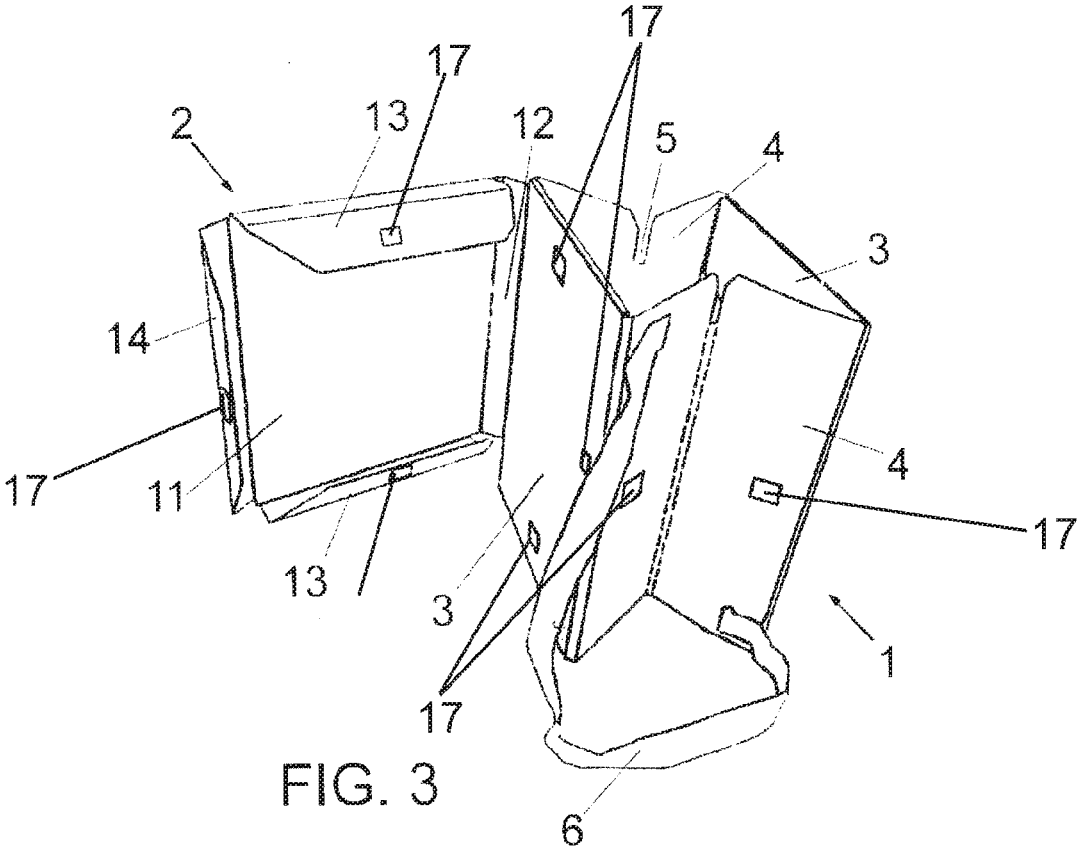
FIG. 3 shows another perspective view of the unit in an intermediate position or state of the unfolding of the body which is going to constitute the chair and the extension, which constitutes the folder, unfolded.
Figure 4:
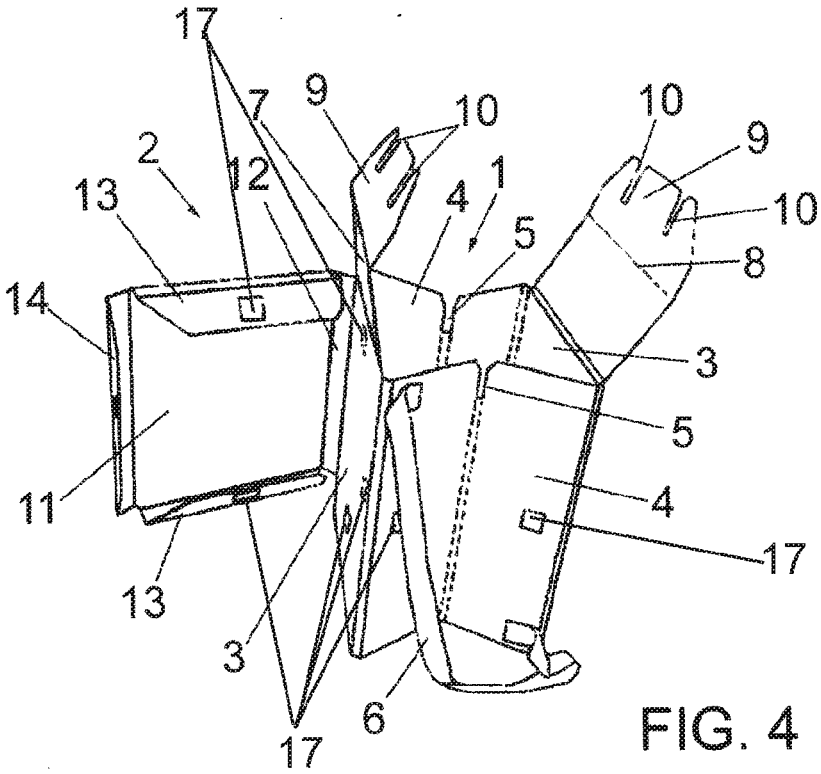
FIG. 4 shows a perspective view like that of the previous figure, allowing the two extensions to be seen which derive from the flat laterals of the body of the seat to form the seat surface per se in a closed position.
Figure 5:
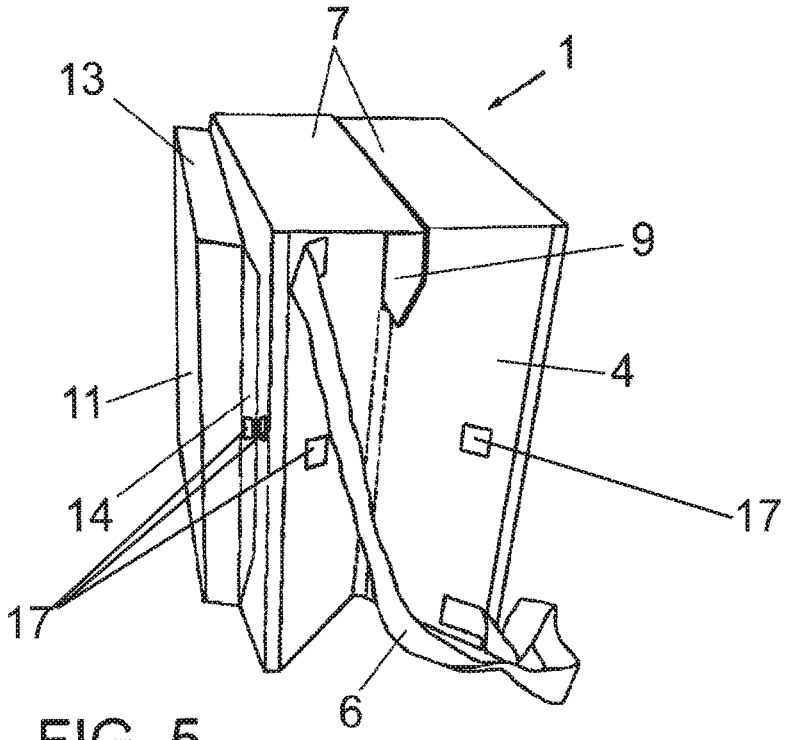
FIG. 5 shows a perspective view of the chair in a position of use and the folder in a closed position, starting from the opening thereof.
Figure 6:
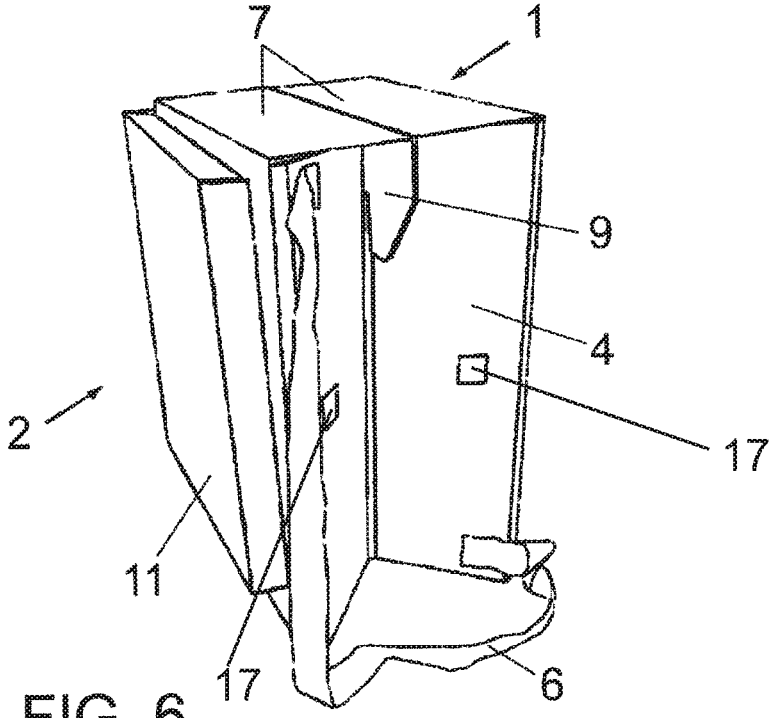
FIG. 6 lastly shows a perspective view of the folder completely folded over the prismatic structure which forms the chair or seat in a position of use.

As can be seen in the figures referred to, the folder-chair of the invention comprises two fundamental parts or elements, one corresponding to a structure (1) for the formation of the chair or seat per se and another (2) corresponding to the folder.

The part (1) corresponding to the chair or seat is formed by a rectangular prismatic body with two flat lateral faces (3) and other faces alternating with these and referenced with the number (4), which are in the form of bellows, these faces in the form of bellows (4) having an upper cutout (5) precisely corresponding to the line which delimits both sectors of the bellows formation of each face (4).

In one of these faces in the form of bellows (4), the fixing is provided, at the ends thereof, for a belt (6) for the transport of the unit.

From the upper edge corresponding to the flat faces (3), extensions (7) are derived which following respective fold lines (8) extends in flaps (9) impinged by a pair of cutouts (10), all of which in a manner such that following the unfolding of the prismatic element or body (1), the extensions (7) are folded over in order to be located horizontally on the upper part and form the seat surface, while the flaps (9) following the fold line thereof (8), are folded inwards and the cutouts (10) fit into the cutouts (5) of the laterals in the form of bellows (4) of the structure, thus perfectly forming a rectangular prismatic body, the upper seat surface of which is formed by the extensions (7), in addition to being perfectly stiffened and assembled based on the flaps (9) and fits between the mentioned cutouts (5 and 10).

An extension (11) is derived from one of the edges of the prismatic body (1) constituting the chair or seat per se following a double fold line, in which the double fold line defines a narrow section (12) which is going to correspond to the depth or thickness of the folder which is going to form the extension (11) together with the flat lateral face (3) from which it is derived, and lateral flaps (13) and another flap (14) opposing this section (12) of the double fold line, such that the flap (14) is going to form the closure of the folder.

In the flap (14) as well as in the corresponding face (3) of the body (1), there are included complementary means for mutual fixing in order to achieve the folder, in the folded arrangement thereof or attached to the lateral (3) of the body (1), it is folded or unfolded, staying in the closed state.

At the same time, the flaps (13) of the folder also have means complementary (17) to others provided on the face (3) of the body (1) for maintaining the folder attached and perfectly fixed to the face (3) of the body (1) and the means of which can be small strips of Velcro® adhesive, clasps or hooks, or any other fixing element which allows connecting or disconnecting, that is to say, folding and unfolding of the folder (2) with respect to the body (1).

Figure 7:
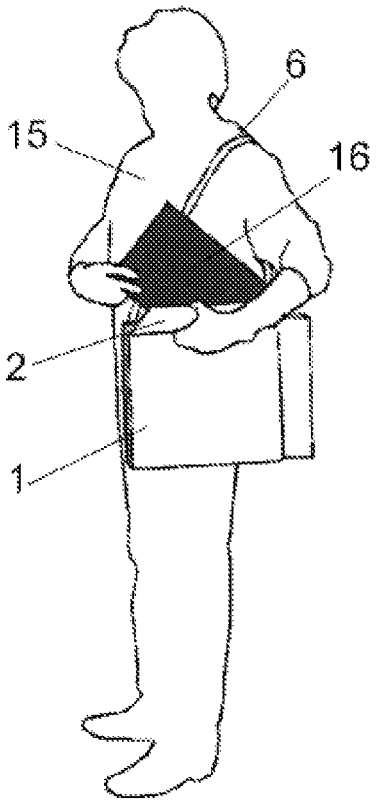
FIG. 7 lastly shows a perspective view of the form in which the folder-chair can be carried in a folded state, allowing to be seen how the user introduces a document into the interior of the folder.

Lastly, to say that in FIG. 7, it can be seen how a user (15) transports the folder-chair on a should strap by means of the belt (6), the introduction of a document into the interior of the folder (2) being observed, and wherein the chair is in this case completely folded, as can be seen in FIG. 1.

The invention claimed is:

1. A transportable folder-chair, that are foldable and unfoldable as a single unit, comprising a folder part and a chair part, wherein the chair part having a rectangular prismatic design comprises:

a first and second lateral flat faces, the first lateral flat face facing the folder part of the single unit;

a first and second side faces in the form of bellows joined to the first and second lateral flat faces;

a first and second extensions, each extension extending from an upper surface of each of the first and second lateral flat faces, each extension having a fold line and a flap, the flap having cutouts such that the first and second extensions are folded over so as to be horizontally flat on the upper surface of the lateral flat faces to form a seat surface, in a position of use of the chair;

a set of complementary fasteners affixed on the first and second side faces;

at least three fasteners affixed to the first lateral flat face facing the folder part of the single unit, and the folder part having a rectangular prismatic design comprises:

a third lateral flat face extending from the first lateral face;

a double fold line defining a narrow section which corresponds to a depth or thickness of the folder between the third lateral face and the first lateral face, thereby joining the folder part and the seat part;

three lateral flaps, having fold lines, extending from the third lateral flat face, each of the lateral flaps comprising at least one fastener affixed thereto which is complementary to the at least three fasteners affixed to one of the two lateral flat faces facing the folder part of the single unit, and a strap affixed at two ends of the second side face, opposite to the double fold line, for transporting the single unit in a folded position.

2. The transportable folder-chair according to claim 1, wherein on an upper surface of each of the first and second side faces comprises upper cutout portions corresponding to cutouts of the flaps of the first and second extensions, and configured to connect and lock in position thereby preventing from undesired dismantling of the structure of the chair or seat when in the position of use of the chair.

3. The transportable folder-chair according to claim 1, wherein the complementary fasteners affixed on the first and second side faces, the at least three fasteners affixed to the first lateral flat face facing the folder part of the single unit and the at least one fastener affixed to the three lateral flaps of the folder part are complementary tabs and cutouts.

4. The transportable folder-chair according to claim 1, wherein the complementary fasteners affixed on the first and second side faces, the at least three fasteners affixed to the first lateral flat face facing the folder part of the single unit and the at least one fastener affixed to the three lateral flaps of the folder part are complementary adhesive Velcro® strips, straps or patches.

5. The transportable folder-chair according to claim 1, wherein the complementary fasteners affixed on the first and second side faces, the at least three fasteners affixed to the first lateral flat face facing the folder part of the single unit and the at least one fastener affixed to the three lateral flaps of the folder part are complementary fastening elements.

6. The transportable folder-chair according to claim 5, wherein the complementary fastening elements are clasps or hooks.

* * * * *